United States Patent [19]

Fyfe

[11] 4,037,795

[45] July 26, 1977

[54] WASTE DISPOSAL SYSTEMS

[76] Inventor: Donald R. Fyfe, 60 Raisins Hill, Pinner, Middlesex, England

[21] Appl. No.: 646,919

[22] Filed: Jan. 6, 1976

[30] Foreign Application Priority Data

Jan. 8, 1975 United Kingdom ..... 853/75
May 17, 1975 United Kingdom ..... 21056/75

[51] Int. Cl.[2] ..... B02C 23/30

[52] U.S. Cl. ..... 241/58; 241/73; 241/79.1; 241/89; 241/DIG. 38

[58] Field of Search ..... 241/42, 44, 47, 49, 241/57, 58, 73, 79.1, 89, DIG. 38

[56] References Cited

U.S. PATENT DOCUMENTS

| | | | |
|---|---|---|---|
| 836,162 | 11/1906 | Williams | 241/89 |
| 1,893,505 | 1/1933 | Nungesser | 241/42 |
| 3,323,650 | 6/1967 | Kilbane | 241/42 |
| 3,664,592 | 5/1972 | Schweigert et al. | 241/73 |
| 3,856,217 | 12/1974 | Brewer | 241/DIG. 38 |

*Primary Examiner*—Granville Y. Custer, Jr.
*Attorney, Agent, or Firm*—Diller, Brown, Ramik & Wight

[57] ABSTRACT

A centralized vacuum waste disposal system, particularly for use in hospitals, comprises one or more shredding machines feeding a remote incinerator via a ducting system through which shredded waste is drawn by an air compressor. To prevent contaminated air escaping from the system if the compressor stops running, an auxiliary device is provided to maintain a partial vacuum at all times. In addition the shredding machines preferably have drop-out exit grilles to permit efficient scavenging of the machines, and germicidal sprays for drenching the interior of the machines.

8 Claims, 4 Drawing Figures

WASTE DISPOSAL SYSTEMS

This invention relates to waste disposal systems and machines, for example waste disposal systems of the kind comprising at least one comminuting machine having a loading port and being arranged to feed comminuted waste through ducting to a common plant for incinerating solid matter from the waste and sterilizing the remaining matter in or with the waste, the system including a machine such as a compressor or blower for drawing the comminuted waste through the ducting by air suction. Such a system will be called in this specification a "system of the kind specified".

Where such a system is used for disposal of infected matter, in hospitals for example, it is essential to ensure that there is no chance of air, which may have become contaminated within the waste disposal system, being able to escape through the loading port or other opening of the comminuting machine. Similarly, should a leak occur in the system, at least upstream of the compressor, contaminated air should not be allowed to escape through such leak. It is also desirable to ensure that each comminuting machine can be regularly emptied of any residual matter that may be lingering in the machine.

According to the invention, a system of the kind specified includes pressure-reducing means for ensuring an air pressure in the system which is always less than ambient pressure.

Preferably there is also provided means for providing germicidal conditions within the or each comminuting machine, such means being operable at least while the loading port of the machine is open.

According to a preferred feature of the invention, the or each comminuting machine has at least one exit grille through which comminuted waste is discharged from the machine, said grille being movable to an open position clear of the path of said waste.

Preferably, the or each comminuting machine has means for holding the loading port closed while the grille is open, so that application of a partial vacuum to the machine will enable any residual matter lingering in the machine to be sucked out into the ducting; the grilles, being in their open position, are clear of the path of this matter.

Embodiments of the invention will now be described by way of example and with reference to the accompanying simplified drawings, of which:

Figure 1:
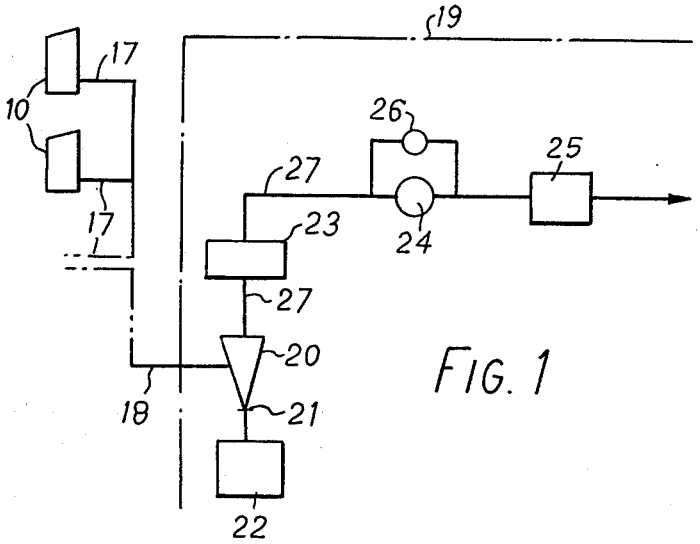
FIG. 1 is a diagram showing principal parts of a waste disposal system of the kind specified.
Figure 2:
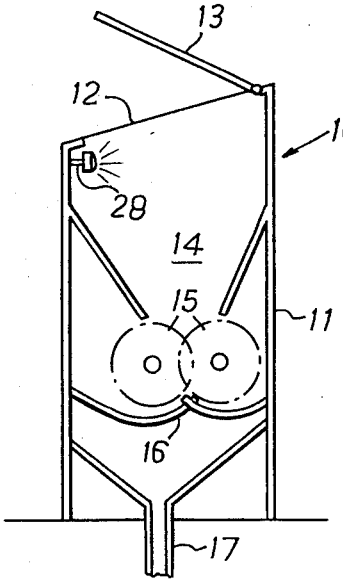
FIG. 2 is a sectional elevation showing diagrammatically a comminuting machine of the system.

The system shown in FIG. 1 comprises a number of comminuting machines in the form of waste shredders 10, of which there is one to each ward, operating theatre and other parts of a hospital in which the system is installed. Each shredder has a cabinet 11 with a loading port 12 sealed by a lid or door 13 which can be opened to allow contaminated dressings and other waste to be placed in a hopper 14, from which the waste passes through a pair of rotary cutter assemblies 15 to fall, when sufficiently comminuted thereby, through a grid assembly 16 and thence into a duct 17.

The ducts 17, of relatively small diameter, all lead through a common duct 18 to a remote disposal station 19, where the duct 18 leads into a cyclone separator 20, whence solid matter passes through a hopper valve 21 to an incinerator 22. Air from the separator 20 is filtered by a cyclone filter 23, where liquid is removed, and passes thence through ducting 27, a main compressor 24 and outlet filter 25 to atmosphere.

An auxiliary compressor 26 is provided in parallel with the main compressor 24. In operation, the latter maintains a continuous upstream pressure substantially below atmospheric pressure, to draw air carrying the comminuted waste through the ducting 17, 18, 27. The air pressure in the shredder hoppers 14 is thus also maintained at less than ambient pressure so that there is a continuous flow of air into the hopper through the port 12 and no flow in the opposite direction. Should the compressor 24 be stopped or the air pressure upstream thereof rise beyond an acceptable value for any other reason, the compressor 26 operates to maintain the partial vacuum upstream of itself. For this purpose it is operated by a pressure responsive device in the ducting at the suction end of, or upstream of, the compressors.

Each shredder hopper 14 has a germicide spray head, diagrammatically indicated at 28, which sprays the inside of the hopper 14 with germicide at least while the lid 13 is open. The spray head is supplied with germicide through a valve, not shown, and preferably arranged to open as the lid is opened and to remain open for a predetermined time after the lid is closed. For this purpose the valve is preferably coupled with a timer, not shown.

Figure 3:
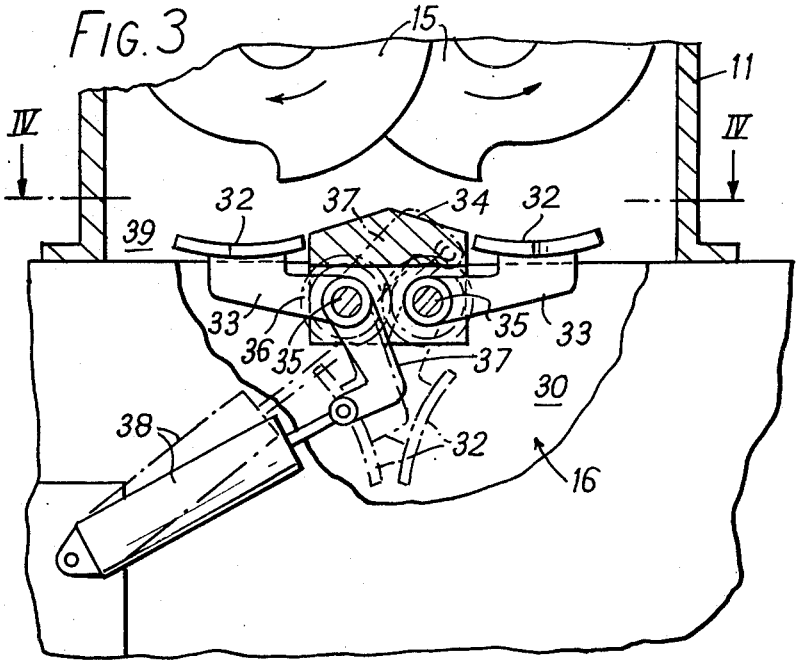
FIG. 3 is a partly cut-away elevation of part of a comminuting machine incorporating features of the invention.
Figure 4:
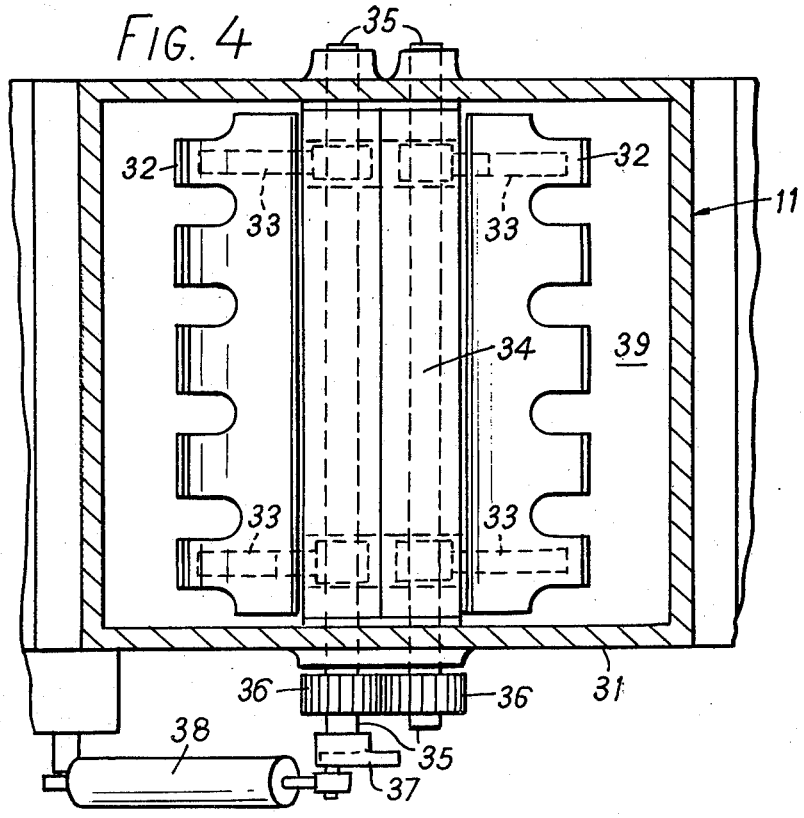
FIG. 4 is a plan view taken generally on the line IV—IV in FIG. 3.

Referring now to FIGS. 3 and 4, the machine of which part is shown therein is a shredding machine, of a typical kind suitable for use in the system shown in FIG. 1 and having a cabinet 11 with a loading port 12 at the top, this port being sealed by a lid or door which can be opened to allow waste to be placed in a hopper within the cabinet 11. From the hopper waste passes downward through a pair of contrarotating rotary cutter assemblies 15, to fall, when sufficiently comminuted thereby, through a grid assembly 16.

Below the cutter assemblies 15 the cabinet has an exit chamber 30, part of the sidewall of which is shown cut away in FIG. 3. Also in FIG. 3 the sidewall 31 of the upper part of the cabinet is omitted, while in FIG. 4 the cutter assemblies 15 are omitted.

The grid assembly 16 includes a pair of grilles or grid plates 32 each carried by arms 33 and, in the operative position shown in full lines in the drawings, lying parallel to and on either side of a deadplate 34 fixed to the cabinet 11. The arms 33 are fixed to a pair of shafts 35 rotatable in the cabinet and coupled by a pair of equal pinions 36, not shown in FIG. 3. One of the shafts 35 has fixed to it a crank 37 coupled to a hydraulic or pneumatic actuator 38 which is pivoted to the cabinet 11.

In normal operation of the shredder, comminuted waste is urged laterally from the deadplate 34, over the grid plates 32, to be discharged through gaps 39 at the sides of the cabinet 11 into the chamber 30.

To clear the machine of large and/or jammed pieces of waste matter, the actuator 38 is operated to rotate the shafts 35 and so move the grid plates 32 to the open position shwon in chain-dotted lines in FIG. 3, in which position they are clear of the path of any material being removed downwardly from the cabinet 11.

When this machine is part of a system of the kind described with reference to FIG. 1, the exit chamber 30 is connected with a duct 17 of the said system.

The said lid of the cabinet 11 may be coupled to a second hydraulic or pneumatic actuator in known manner by provision of a suitable fluid circuit to close the lid just before the grid plates are opened, and to hold it closed while the grid plates are open. Application of a partial vacuum to the chamber 11 through the exit chamber 30 then enables any waste matter lingering in the cabinet 11 to be removed downwards to the ducting, free of any obstruction by the grid plates 32.

I claim:

1. A waste disposal system comprising a disposal plant, at least one comminuting machine for separately receiving and comminuting waste, said comminuting machine being disposed remote from said disposal plant and having a loading port for waste, a discharge for communited waste, a duct extending between said discharge and said disposal plant and placing said discharge in constant communication with said disposal plant, suction means for drawing comminuted waste through said duct into said disposal plant, and said suction means being in constant communication with said loading port for maintaining a subatmospheric pressure at said loading port at all times, said communiting machine also including rotaty cutters and grill means, and means mounting said grill means for selective movement between a first position in which said grill means are operatively interposed between said cutters and said discharge and a second position in which said grill means are inoperative by not being so interposed.

2. A system according to claim 1 wherein said suction means includes primary compressor means for effecting movement of waste through said duct, and secondary compressor means for only maintaining said subatmospheric pressure when said primary compressor means fails to maintain said subatmospheric pressure.

3. A system according to claim 2 wherein said primary compressor means and said second compressor means are arranged in parallel.

4. A system according to claim 1 wherein said rotary cutters are spaced from said loading port, and there are means adjacent said loading port for providing germicidal conditions in said communiting machine.

5. A system according to claim 4 wherein said means for providing germicidal conditions includes spray means capable of drenching the interior of said communiting machine.

6. A waste disposal system comprising a disposal plant, at least one comminuting machine for separately receiving and communiting waste, said commmuniting machine being disposed remote from said disposal plant and having a loading port for waste, a discharge for communuted waste, a duct extending between said discharge and said disposal plant and placing said discharge in constant communication with said disposal plant, suction means for drawing comminuted waste through said duct into said disposal plant, and said suction means being in constant communication with said loading port for maintaining a subatmospheric pressure at said port at all times, said disposal plant being particularly adapted to handle waste of the type including solids, liquids and gases and including separator means for separating solids from gases and liquids, and said suction means are located downstream of said separator means for drawing liquids and gases from said separator means.

7. A system according to claim 6 together with incinerator means for receiving separated solids from said separator means.

8. A waste disposal system comprising a disposal plant, at least one comminuting machine for separately receiving and comminuting waste, said comminuting machine being disposed remote from said disposal plant and having a loading port for waste, a discharge for comminuted waste, a duct extending between said discharge and said disposal plant and placing said discharge in constant communication with said disposal plant, suction means for drawing comminuted waste through said duct into said disposal plant, and said suction means being in constant communication with said loading port for maintainiing a subatmospheric pressure at said port at all times, said comminuting machine including a pair of cooperating parallel rotary cutters, a dead plate located centrally below said cutters, separate grills on opposite sides of said dead plate, pivot means pivotally mounting each grill, and common actuator means connected to said pivot means for selectively moving said grills between operative and inoperative positions.

* * * * *